US007948158B2

(12) United States Patent
Kato et al.

(10) Patent No.: US 7,948,158 B2
(45) Date of Patent: May 24, 2011

(54) PLASMA IGNITION SYSTEM WITH RECESS PORTON IN THE CENTER ELECTRODE

(75) Inventors: Hideyuki Kato, Nishio (JP); Tohru Yoshinaga, Okazaki (JP)

(73) Assignee: Denso Corporation, Kariya (JP)

( * ) Notice: Subject to any disclaimer, the term of this patent is extended or adjusted under 35 U.S.C. 154(b) by 322 days.

(21) Appl. No.: 12/175,117

(22) Filed: Jul. 17, 2008

(65) Prior Publication Data

US 2009/0021133 A1 Jan. 22, 2009

(30) Foreign Application Priority Data

Jul. 17, 2007 (JP) ..... 2007-185670

(51) Int. Cl.
*H01T 13/20* (2006.01)
*H01T 13/34* (2006.01)
*H01T 13/52* (2006.01)

(52) U.S. Cl. ..... 313/131 R; 313/138; 313/141; 313/143; 123/169 R; 123/169 EL

(58) Field of Classification Search ..... 313/118, 313/130, 131 R, 138, 141–143, 131 A, 132, 313/139; 123/143 B, 143 R, 144, 169 E, 123/169 R
See application file for complete search history.

(56) References Cited

U.S. PATENT DOCUMENTS

| | | | |
|---|---|---|---|
| 3,581,141 | A | 5/1971 | Beaubier |
| 2007/0114898 | A1 | 5/2007 | Nagasawa et al. |

FOREIGN PATENT DOCUMENTS

| | | | |
|---|---|---|---|
| JP | 5635793 | U * | 8/1980 |
| JP | 56-35793 | | 4/1981 |
| JP | 57-29089 | | 2/1982 |
| JP | 2006-294257 | | 10/2006 |
| JP | 2006294257 | A * | 10/2006 |
| JP | 2007-134127 | | 5/2007 |

OTHER PUBLICATIONS

Translation of JP 5635793.*
Machine translation of JP 2006294257A.*
Japanese Office Action dated Jun. 16, 2009, issued in corresponding Japanese Application No. 2007-185670, with English translation.

* cited by examiner

*Primary Examiner* — Nimeshkumar D Patel
*Assistant Examiner* — Steven Horikoshi
(74) *Attorney, Agent, or Firm* — Nixon & Vanderhye PC

(57) ABSTRACT

A plasma ignition system includes an ignition plug attached to an engine and a high-voltage supply. The plug includes a center electrode serving as a positive pole, a ground electrode serving as a negative pole, and an insulating member insulating the center electrode from the ground electrode and defining a discharge space therein. At least a part of a surface of the center electrode faces the space, and at least a part of a surface of the ground electrode faces the discharge space. The plug puts gas in the space into a plasma state and injects the gas into the engine as a result of application of high voltage and supply of a large current to the plug by the high-voltage supply. The center electrode has a recess portion opposed to the space and recessed in a direction opposite to an injection direction.

7 Claims, 7 Drawing Sheets

PLASMA IGNITION SYSTEM WITH RECESS PORTON IN THE CENTER ELECTRODE

CROSS REFERENCE TO RELATED APPLICATION

This application is based on and incorporates herein by reference Japanese Patent Application No. 2007-185670 filed on Jul. 17, 2007.

BACKGROUND OF THE INVENTION

1. Field of the Invention

The present invention relates to measures against electrode wear and improvement in ignition stability in a plasma ignition system used for ignition of an internal combustion engine.

2. Description of Related Art

In an internal combustion engine such as an automobile engine, a plasma ignition system 1*x* shown in FIG. 11A is known. In the system 1*x*, by applying high voltage between a center electrode 110*x* and a ground electrodes 130*x* of the plasma ignition plug 10*x* from a discharge power source 20*x* and by supplying a high current from a plasma generation power source 30*x* at the moment of the start of electric discharge in a discharge space 140*x* formed between the center electrode 110*x* and the ground electrode 130*x*, gas in the discharge space 140*x* is put into a plasma state of high-temperature and pressure and then the gas is injected from a leading end of the discharge space 140*x* so as to carry out ignition. Because the plasma ignition system 1*x* has good directivity and generates a very high temperature range from thousands to tens of thousands of degrees Kelvin (K) in a broad range in volume, the system 1*x* is expected to be applied as an ignition system for a lean burn engine having ignition resistance, such as homogeneous lean burn or stratified lean burn.

As a conventional technology of such a plasma ignition system, a surface gap spark plug is disclosed in U.S. Pat. No. 3,581,141 to prevent deterioration of the center electrode. The above surface gap spark plug includes a center electrode, an insulator having an insertion hole in its center, the hole holding the center electrode and extending longitudinally, a ground electrode, which covers the insulator and has an opening at its lower end, the opening communicating with the insertion hole, and a discharging gap, which is formed in the insertion hole.

Also, a technology which alms to lower discharge voltage is disclosed in JP-U-56-35793. According to the above technology, the discharge voltage is lowered by forming a projection or a recess, where an electric field density is locally high, at an end portion of a discharge surface of a center electrode.

However, in conventional plasma ignition systems such as U.S. Pat. No. 3,581,141 and JP-U-56-35793, the center electrode is used as a negative pole and the ground electrode is used as a positive pole. In this case, as in the case of the plasma ignition system 1*x* shown in FIG. 11B, cathode sputtering whereby the center electrode 110*x* is decomposed is easily generated, since a positive ion 50*x* having high temperature and large mass collides with a surface of the center electrode 110*x*. The surface of the center electrode 110*x* is heavily eroded due to the cathode sputtering. A discharge distance 141*x* between the center electrode 110*x* and the ground electrode 130*x* becomes gradually longer because of the erosion of the center electrode 110*x*. The discharge voltage rises gradually in proportion to the discharge distance 141*x*, and when the discharge voltage reaches a generated voltage of the discharge power source 20*x* or above in the course of time, electricity cannot be discharged and accordingly, there is a possibility of an accidental fire of the engine.

When the portion where the electric field density is locally high is formed on the surface of the center electrode through the formation of the projection or recess, as in the device in JP-U-56-35793, the center electrode still serves as a negative pole, so that the consumption of the center electrode due to the cathode sputtering is unavoidable, although an effect of reducing the discharge voltage is produced in its initial use. More specifically, the portion having the high electric field density is consumed first and consequently, the discharge voltage gradually rises. Eventually, there is a possibility of an accidental fire of the engine.

On the other hand, when the application of high voltage and the high current emission are performed on the inside of a certain discharge space, creeping discharge is generated to creep on a surface of an insulating member 120*x*, and gas around a creeping-discharge path is put into the plasma state. Because density of the gas in the plasma state immediately becomes high, further ionization of the gas becomes difficult despite the continuation of emission of electron. The volume of the discharge space needs to be enlarged in order to put more gas into the plasma state. However, according to the conventional configuration, when the volume of the discharge space is enlarged, the discharge distance becomes long, and accordingly discharge potential becomes high.

Furthermore, in stratified combustion of a lean mixture, accuracy in aiming the gas at a layer in the fuel/air mixture having high fuel concentration needs to be improved, by making an injection length of gas in the plasma state used as an ignition source as long as possible.

SUMMARY OF THE INVENTION

The present invention addresses the above disadvantages. Thus, it is an objective of the present invention to provide a plasma ignition system, which restricts consumption of an electrode due to cathode sputtering to improve durability, and makes longer an injection length of gas in a plasma state to improve ignition stability.

To achieve the objective of the present invention, there is provided a plasma ignition system for an internal combustion engine. The plasma ignition system includes an ignition plug attached to the engine, and a high-energy supply that supplies electrical energy to the ignition plug. The ignition plug includes a center electrode, a ground electrode, and an insulating member that insulates the center electrode from the ground electrode and defines a discharge space therein. The center electrode and the ground electrode are disposed such that at least a part of a surface of the center electrode faces the discharge space and that at least a part of a surface of the ground electrode faces the discharge space. The ignition plug is configured to release the electrical energy, which is supplied to the ignition plug by the high-energy supply, into a combustion chamber of the engine so as to perform ignition in the engine. The center electrode is configured to serve as a positive pole. The ground electrode is configured to serve as a negative pole. The center electrode has a recess portion, which is opposed to the discharge space and recessed in a direction opposite to an injection direction in which the gas is injected into the engine.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
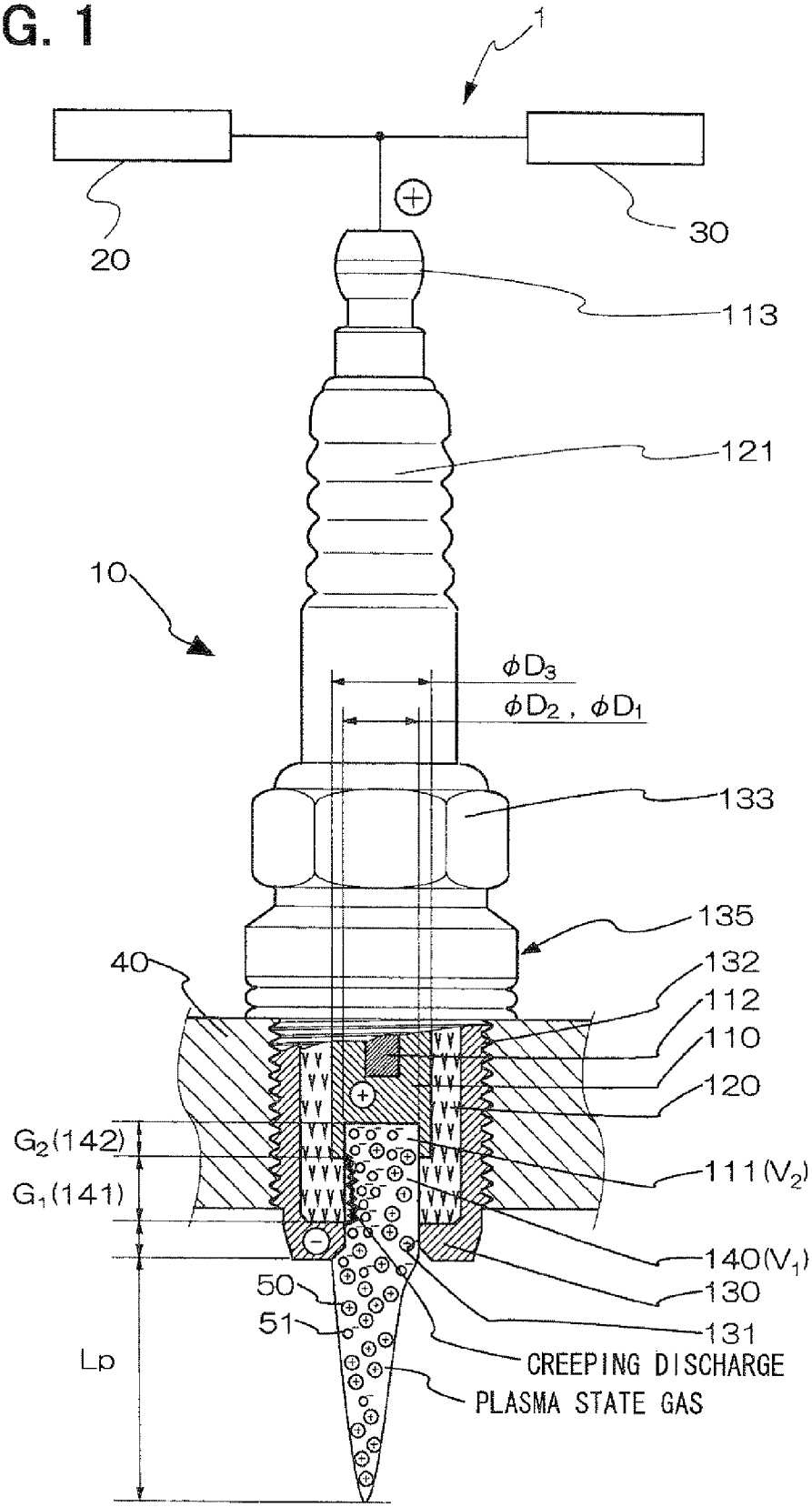
FIG. 1 is a schematic diagram illustrating a configuration of a plasma ignition system according to a first embodiment of the invention.

A first embodiment of the invention is described below with reference to FIG. 1. A plasma ignition system 1 of the first embodiment includes a high voltage power having a discharge power source 20 and a plasma generation power source 30, and a plasma ignition plug 10. The plasma ignition plug 10 includes a center electrode 110, a cylindrical insulating member 120, which insulates and holds the center electrode 110, and an annular ground electrode 130, which covers the insulating member 120. A lower end portion of the center electrode 110 is formed into a shaft shape having a diameter of ϕD1. A recess portion 111 having an inner diameter ϕD2, a depth G2, and volume V2, which is recessed toward an opposite side of the discharge space (rear end side), is formed on a surface of the lower end portion facing a discharge space 140, and a center-electrode terminal area 113 connected to the high voltage power is formed at a rear end side end portion of the center electrode 110.

A leading end side of the center electrode 110 is formed from a high melting point material such as Fe (iron) or Ni (nickel), and a center-electrode axis 112 including a highly conductive metallic material such as Cu (copper) or a ferrous material is formed in the center electrode 110.

The insulating member 120 is formed from, for example, highly-pure alumina, which is excellent in heat resistance, mechanical strength, dielectric strength at high temperature, and heat conductivity. The cylindrical discharge space 140 extending downward from a leading end surface of the center electrode 110 and having an inner diameter D1 and length G1 is formed on a leading end side of the insulating member 120. A center-electrode locking part, which catches the housing 135 via a packing member for maintaining airtightness between the insulating member 120 and a housing 135, is formed in a halfway area of the insulating member 120. An insulating member head portion, which insulates the center electrode 110 from the housing 135 and prevents high voltage from escaping to other areas than the center electrode 110, is formed on a rear end side of the insulating member 120.

A leading end portion of the housing 135 covers an outer circumference of the insulating member 120, and an annular ground electrode 130, a leading end of which is crooked inward, is formed at the leading end portion of the housing 135. A housing thread part 132 for fixing the plasma ignition plug 10 to a wall surface (engine block 40) of an internal combustion engine (not shown) such that the ground electrode 130 is exposed to the inside of the engine and for putting the ground electrode 130 and the engine block 40 into a electrically grounded state is formed on an outer peripheral part of a halfway area of the housing 135. A housing hexagon head part 133 for fastening the housing thread part 132 is formed on an outer peripheral part of a rear end side of the housing 135.

The ground electrode 130 has a ground electrode opening 131, which communicates with the inside of the insulating member 120 and is opposed to the discharge space 140. An opening diameter ϕD1 of a lower end of the recess portion 111 of the center electrode 110 is generally the same as an inner diameter ϕD2 of the insulating member 120, which defines the discharge space 140. Alternatively, a relationship between the recess portion opening diameter (ϕD1) and the insulating member inner diameter (ϕD2) may satisfy $D2 \leqq D1$, or the recess portion 111 and the insulating member 120 may be formed such that a difference in level is not caused between an inner surface of the recess portion 111 and an inner surface of the insulating member 120 due to a difference between the recess portion opening diameter (ϕD1) and the insulating member inner diameter (ϕD2).

Because volume of the recess portion 111 at its portion close to the discharge path is maximized, the supplied energy is most efficiently utilized for putting the gas in the discharge space 140 and the recess portion 111 into the plasma state.

A relationship between an outer diameter ϕD3 of the center electrode 110 at its portion serving as an inner circumferential wall of the recess portion 111 and the inner diameter ϕD2 of the insulating member 120 defining the discharge space 140 is set to satisfy $D2 \leqq D3 \leqq 2 \times D2$.

The electric field density at a portion of the recess portion 111 serving as its vertical wall becomes high and consequently, the discharge voltage is made even lower.

A relationship among a distance G1 from a lower end surface of the center electrode 110 to a surface of the ground electrode 130 at a boundary between the ground electrode 130 and a lower end portion of the insulating member 120, the depth G2 of the recess portion 111, volume V1 of the discharge space 140, and the volume V2 of the recess portion 111 is set to satisfy $G2<G1$ and $V1<V1+V2<2 \times V1$.

When the recess portion 111 is enlarged too much, an amount of the gas that is put into the plasma state becomes smaller than the total volume Vt of the volume V1 of the discharge space 140 and the volume V2 of the recess portion 111, since an amount of gas that is able to be ionized by a constant discharge voltage is limited. Accordingly, the volume V1 and the volume V2 have their optimum values. More specifically, by forming the recess portion 111 to satisfy the above-prescribed ranges, the gas in the discharge space 140 and the gas in the recess portion 111 are most efficiently put into the plasma state. As a result, the plasma ignition system 1, which is extremely excellent in durability and excellent in ignition stability of the engine, is realized.

Figure 2:
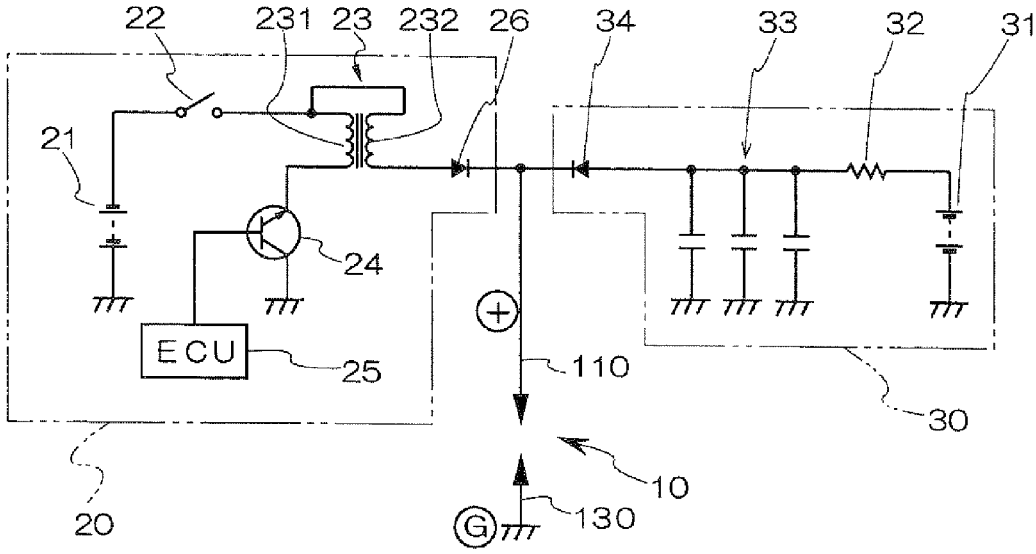
FIG. 2 is a representative circuit schematic illustrating a circuit configuration of the plasma ignition system of the first embodiment.

In the first embodiment, as shown in FIG. 2, polarities of the discharge power source 20 and the plasma generation power source 30 are set such that the center electrode 110-side serves as a positive pole and the ground electrode 130-side serves as a negative pole. The discharge power source 20 includes a first battery 21, an ignition key 22, an ignition coil 23, an igniter having a transistor, and an electronic control unit (ECU) 25. The discharge power source 20 is connected to the plasma ignition plug 10 through a first rectifying device 26. A positive pole side of the first battery 21 is grounded.

The plasma generation power source 30 includes a second battery 31, a resistance 32, and a plasma generation capacitor 33. The plasma generation power source 30 is connected to the plasma ignition plug 10 through a second rectifying device 34. A negative pole side of the second battery 31 is grounded.

When an ignition switch 22 is thrown, a negative and low primary voltage is applied to a primary coil 231 of the ignition coil 23 from the first battery 21 in response to an ignition signal from the ECU 25. When the primary voltage is cut off by switching of an ignition coil drive circuit 24, a magnetic field in the ignition coil 23 changes and accordingly, a positive secondary voltage ranging from 10 to 30 kV is induced in a secondary coil 232 of the ignition coil 23 due to a self-induction effect.

On the other hand, the plasma generation capacitor 33 is charged by the second battery 31. When the applied secondary voltage is larger than a discharge voltage proportional to a discharge distance 141 between the center electrode 110 and the ground electrode 130, electric discharge is started between both the electrodes and thereby gas in the discharge space 140 is put into a plasma state in a small region. The gas in the plasma state has conductivity and causes discharge of electric charge stored between both poles of the plasma generation capacitor 33. Accordingly, the gas in the discharge space 140 is further put into the plasma state and the above region is expanded. The gas in the plasma state has high temperature and pressure and is injected into a combustion chamber of the engine. Meanwhile, not only the gas in the discharge space 140 but also gas in the recess portion 111 is put in the plasma state of high temperature and pressure. Therefore, a plasma injection length Lp becomes very long.

Although a positive ion 50 having large mass collides with a surface of the opening 131 provided on the ground electrode 130, a collision angle of the positive ion 50 is shallow and thereby collision force of the positive ion 50 is mitigated because the opening 131 is disposed in a direction generally perpendicular to an injection direction of the gas in the plasma state. In addition, the ground electrode 130-side easily releases heat to the engine block 40 and is thereby easily cooled despite the collision with the high-temperature positive ion 50, so that the ground electrode 130 is resistant to its consumption caused by cathode sputtering.

On the other hand, the positive ion 50 does not collide with a surface of the center electrode 110 serving as a positive pole because the positive ion 50 is repelled by the surface due to electrostatic repulsion. Only an electron 51 having small mass collides with the surface of the center electrode 110 and accordingly erosion due to the cathode sputtering does not take place easily.

Advantageous effects of the invention are described below with reference to FIGS. 3, 4. As shown in Table 1, a first comparative example is configured not to include a recess portion 111, and a second comparative example is configured such that an outer diameter ϕD3 of a center electrode 110 is equal to an inner diameter ϕD1 of an insulating member 120 and that an inner diameter ϕD2 of a recess portion 111 is smaller than the outer diameter ϕD3 of the center electrode 110. The first embodiment is configured such that the outer diameter ϕD3 of the center electrode 110 is larger than the inner diameter ϕD1 of the insulating member 120 and that the inner diameter ϕD2 of the recess portion 111 is equal to the inner diameter ϕD1 of the insulating member 120, and a second embodiment of the invention is configured such that the depth G2 of the recess portion 111 is larger than the first embodiment.

TABLE 1

| | 1st comparative example | 2nd comparative example | 1st embodiment | 2nd embodiment |
|---|---|---|---|---|
| Outer dia. of center electrode ϕD3 | 1.3 mm | 1.3 mm | 2.0 mm | 2.0 mm |
| Inner dia. of discharge space ϕD2 | 1.3 mm | 1.3 mm | 1.3 mm | 1.3 mm |
| Inner dia. of recess portion ϕD1 | N/A | 0.6 mm | 1.3 mm | 1.3 mm |
| Depth of recess portion G2 | N/A | 1.5 mm | 1.0 mm | 2.0 mm |
| Discharging gap G1 | 2.0 mm | 2.0 mm | 2.0 mm | 2.0 mm |
| Discharge voltage V | 14 kV | 13 kV | 12 kV | 12 kV |
| Vol. of recess portion V2 | N/A | 0.43 $mm^3$ | 1.33 $mm^3$ | 2.65 $mm^3$ |
| Discharge space total vol. Vt = V1 + V2 | 2.65 $mm^3$ | 3.08 $mm^3$ | 3.98 $mm^3$ | 5.31 $mm^3$ |
| Injection length Lp | 2.2 mm | 2.3 mm | 3.0 mm | 2.8 mm |

As shown in Table 1, an electric field density of a portion defining a vertical wall of the recess portion 111 is increased due to the existence of the recess portion 111, and thereby electricity is easily discharged. When the inner diameter ϕD2 of the recess portion 111 is generally equal to the inner diameter ϕD1 of the insulating member 120, a distance between a corner portion of an opening at a lower end of the recess portion 111 and a creeping-discharge path formed to creep on a surface of an inner circumferential wall of the insulating member 120 is extremely small, and a discharge voltage V becomes even lower.

Figure 3:
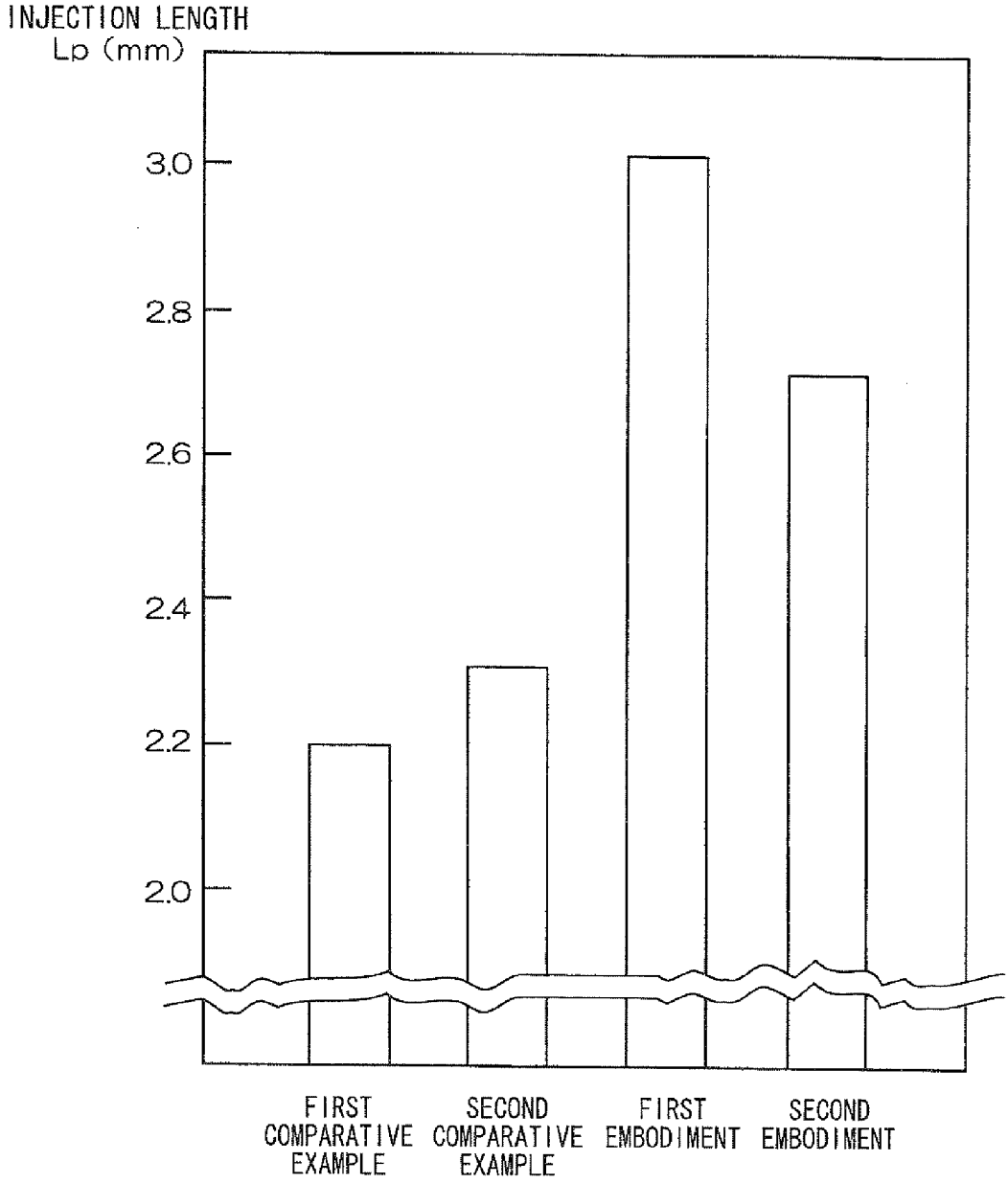
FIG. 3 is a characteristic graph illustrating advantageous effects of the first embodiment together with comparative examples.

FIG. 3 shows the result of measurement of the plasma injection length Lp with respect to the first comparative example, the second comparative example, the first embodiment, and the second embodiment. As shown in FIG. 3, according to the invention, the plasma injection length Lp is most lengthened.

Figure 4:
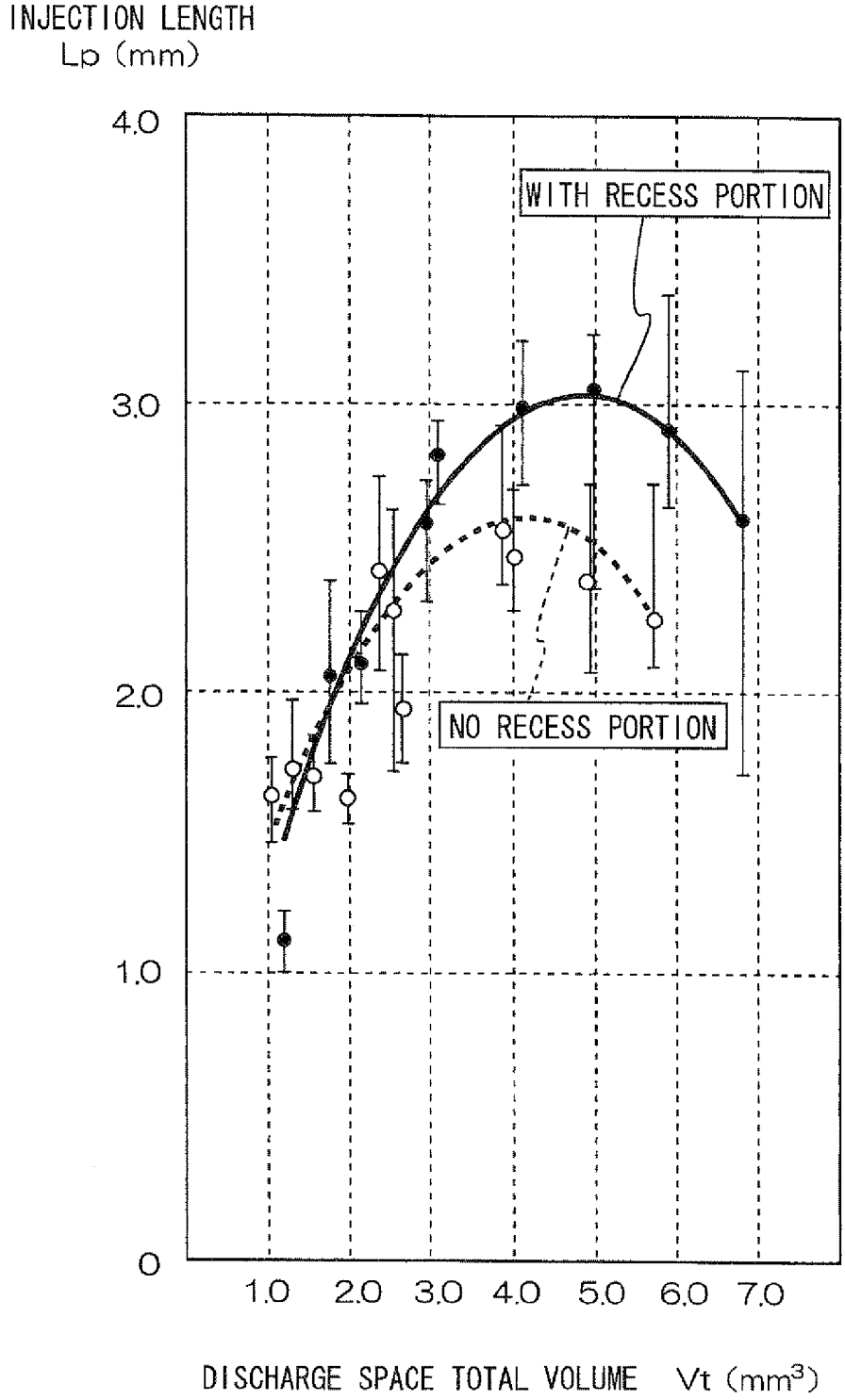
FIG. 4 is a characteristic graph illustrating the advantageous effects of the first embodiment.

FIG. 4 is a characteristic diagram illustrating the result of the measurement of the plasma injection length Lp when discharge space total volume Vt is changed in a more detailed manner to verify the effects of the invention. As shown in FIG. 4, both in a case where the recess portion 111 is formed and in a case where the recess portion 111 is not formed, the plasma injection length Lp gradually becomes longer as the discharge space total volume Vt becomes larger. Nevertheless, when the discharge space total volume Vt becomes equal to or larger than certain volume, the plasma injection length Lp becomes conversely shorter. Also, the plasma injection length Lp becomes longer in the case where the recess portion 111 is formed than in the case where the recess portion 111 is not formed, despite the same discharge space total volume Vt.

Each of FIGS. 5 to 10 is a partly cutaway perspective view illustrating a main portion of a plasma ignition plug 10 used for a plasma ignition system 1 according to embodiments of the invention. In the following embodiments, their basic configurations are the same as the first embodiment, and a shape of an inner circumferential wall of a recess portion 111 of the plasma ignition plug 10 or an inner circumferential wall of an insulating member 120 is different from the first embodiment.

According to the invention, a minimum distance from a surface of an uppermost part of the ground electrode 130 to a surface of a lowermost part of the center electrode 110 is the discharge distance 141 and accordingly, the discharge voltage is constant. On the other hand, because of the high current supplied from the power source for supply of a high current, the electrons 51 are emitted to the space defined by the inner circumferential wall of the recess portion 111, as well as to the discharge space 140 defined by an inner circumferential wall of the insulating member 120. Accordingly, the volume of the gas, which is put into the plasma state, is increased without increasing the discharge voltage. Furthermore, the center electrode 110 serves as a positive pole. Thus, in the ionized gas of high temperature and pressure in the plasma state, the positive ion 50 having large mass is repelled by the center electrode 110 due to the electrostatic repulsion, and only the electron 51 having small mass collides with the center electrode 110. Consequently, the center electrode 110 is not easily eroded due to the cathode sputtering. Therefore, according to the invention, the durability of the plasma ignition system 1 is improved, and an amount of the gas that is put into the plasma state is increased with respect to a constant discharge voltage, so that the ignitionability of the engine is improved.

On the other hand, while the ground electrode 130 serving as a negative pole can be eroded due to the cathode sputtering, a collision angle of the positive ion 50 with the ground electrode 130 is shallow, and thus the collision force of the positive ion 50 is eased, because the surface of the ground electrode 130 faces in a direction generally perpendicular to the injection direction of the gas in the plasma state. Moreover, since the ground electrode 130-side easily releases heat to the grounded part of the engine, the consumption of the electrodes is not easily caused by the cathode sputtering compared to when the center electrode 110 is used as a negative pole in a conventional manner. As a result, according to the invention, the durability of the plasma ignition system 1 that is excellent in ignition stability is further improved.

Figure 5:
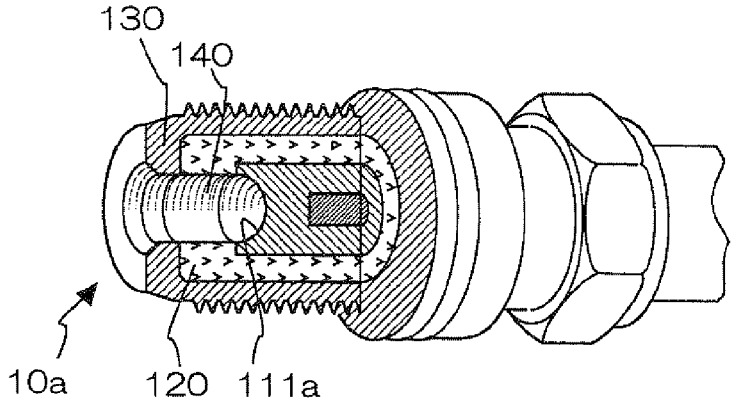
FIG. 5 is a cutaway perspective view illustrating a second embodiment of the invention, in which a center-electrode recess portion is formed in an ellipse spherical concave shape.

As shown in FIG. 5, in a plasma ignition plug 10*a* according to a second embodiment of the invention, a center-electrode recess portion 111*a* is formed in a shape of a half-ellipse spherical surface. By virtue of the above configuration, the following advantageous effect is produced in addition to a similar effect to the first embodiment. That is, when the center-electrode recess portion 111*a* is formed to have the same recess portion volume V2 as the first embodiment, a surface area of an inner circumferential wall of the center-electrode recess portion 111*a* is larger than the first embodiment. Accordingly, it is expected that a probability of occurrence of gas ionized by an electron released into the center-electrode recess portion 111*a* is made high.

Figure 6:
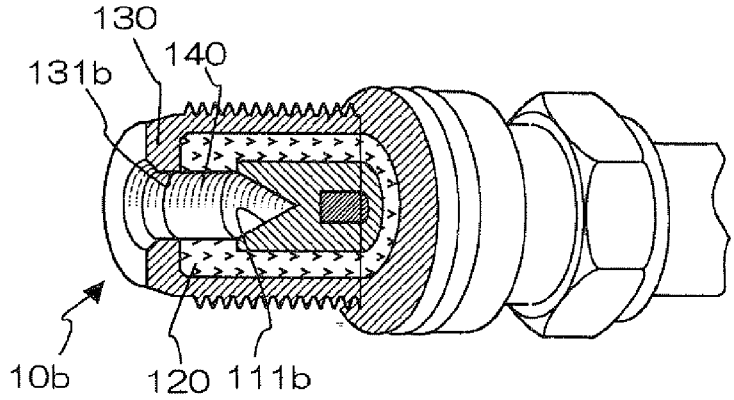
FIG. 6 is a cutaway perspective view illustrating a third embodiment of the invention, in which a center-electrode recess portion is formed in a conical shape.

As shown in FIG. 6, in a plasma ignition plug 10*b* according to a third embodiment of the invention, a center-electrode recess portion 111*b* is formed in a conical shape. By virtue of the above configuration, in addition to a similar effect to the first embodiment, an injection pressure when pressure in the center-electrode recess portion 111*b* is increased is concentrated into a ground electrode opening 131*b*, and thereby a plasma injection length Lp is expected to be even longer.

Figure 7:
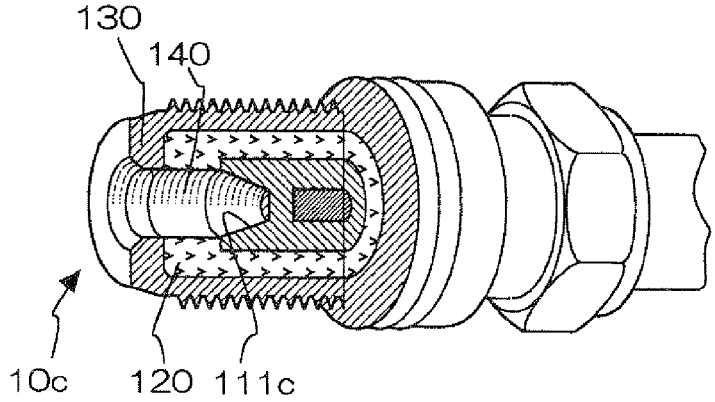
FIG. 7 is a cutaway perspective view illustrating a fourth embodiment of the invention, in which a center-electrode recess portion is formed in a generally trapezoidal shape at its longitudinal section.

As shown in FIG. 7, in a plasma ignition plug 10*c* according to a fourth embodiment of the invention, a center-electrode recess portion 111*c* is formed in a shape of a truncated cone. By virtue of the above configuration, in addition to a similar effect to the first embodiment, a similar effect to the third embodiment is expected to be produced.

Figure 8:
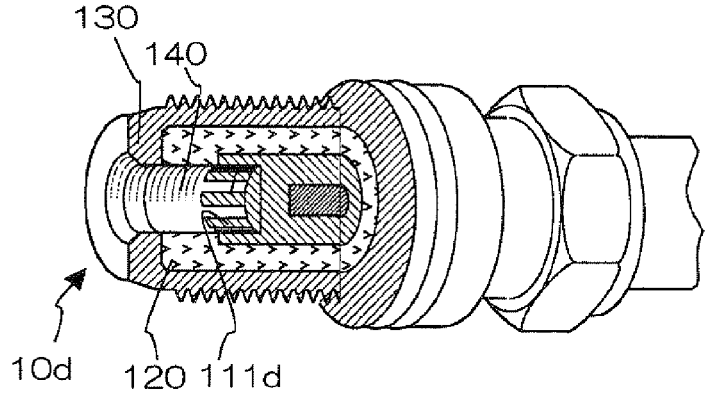
FIG. 8 is a cutaway perspective view illustrating a fifth embodiment of the invention, in which a center electrode is multipolarized.

As shown in FIG. 8, a plasma ignition plug 10*d* according to a fifth embodiment of the invention is configured such that a wall surface of a center-electrode recess portion 111*d* is partly notched and an insulating member is inserted therebetween so as to achieve multipolarity. By virtue of the above configuration, in addition to a similar effect to the first embodiment, it is expected that an electric field density in the center-electrode recess portion 111*d* is further increased and accordingly the discharge voltage is further lowered.

Figure 9:
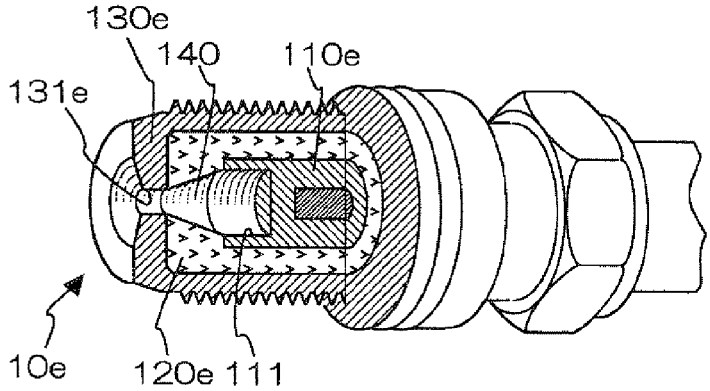
FIG. 9 is a cutaway perspective view illustrating a sixth embodiment of the invention, in which an inner circumferential wall of an insulating member is formed in a generally conical shape, a diameter of which decreases in an injection direction.

As shown in FIG. 9, in a plasma ignition plug 10*e* according to a sixth embodiment of the invention, an inner circumferential wall of an insulating member 120*e* is formed in a conical shape, in which an inner diameter of the insulating member 120*e* becomes smaller in a direction from a center-electrode 110*e*-side toward a ground electrode 130*e*-side. By virtue of the above configuration, in addition to a similar effect to the first embodiment, the gas in the plasma state is injected to be squeezed out through a narrow ground electrode opening 131*e* and consequently a plasma injection length Lp is expected to be further lengthened.

Since the gas in the plasma state having high temperature and pressure, which is generated in the discharge space 140 is injected to be squeezed out through the narrow ground electrode opening 131*e*, the plasma injection length Lp becomes even longer, and as a result, the ignition stability is expected to be improved in the stratified combustion.

Figure 10:
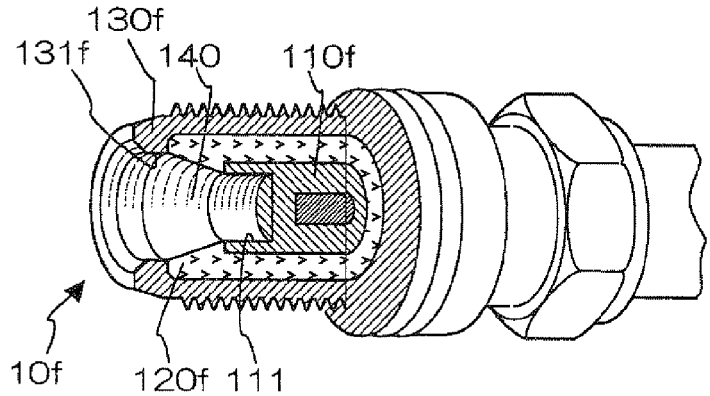
FIG. 10 is a cutaway perspective view illustrating a seventh embodiment of the invention, in which an inner circumferential wall of an insulating member is formed in a generally conical shape, a diameter of which increases in an injection direction.
Figure 11A:
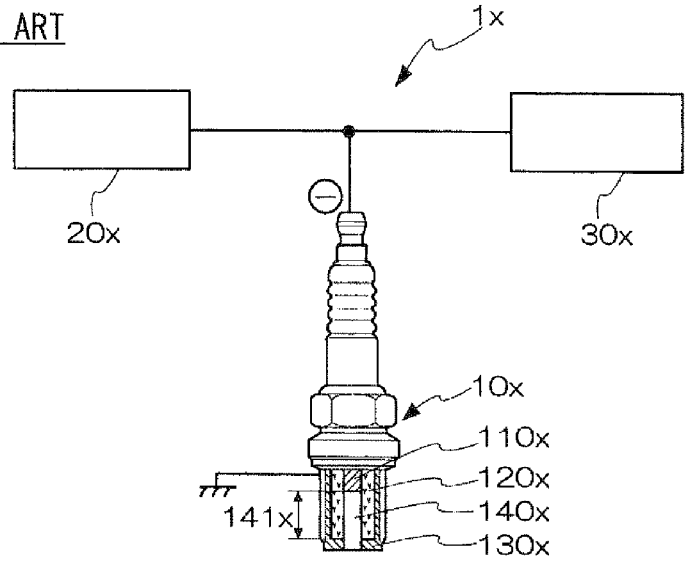
FIG. 11A PRIOR ART
FIG. 11A is a schematic diagram illustrating a configuration of a previously proposed plasma ignition system.
Figure 11B:
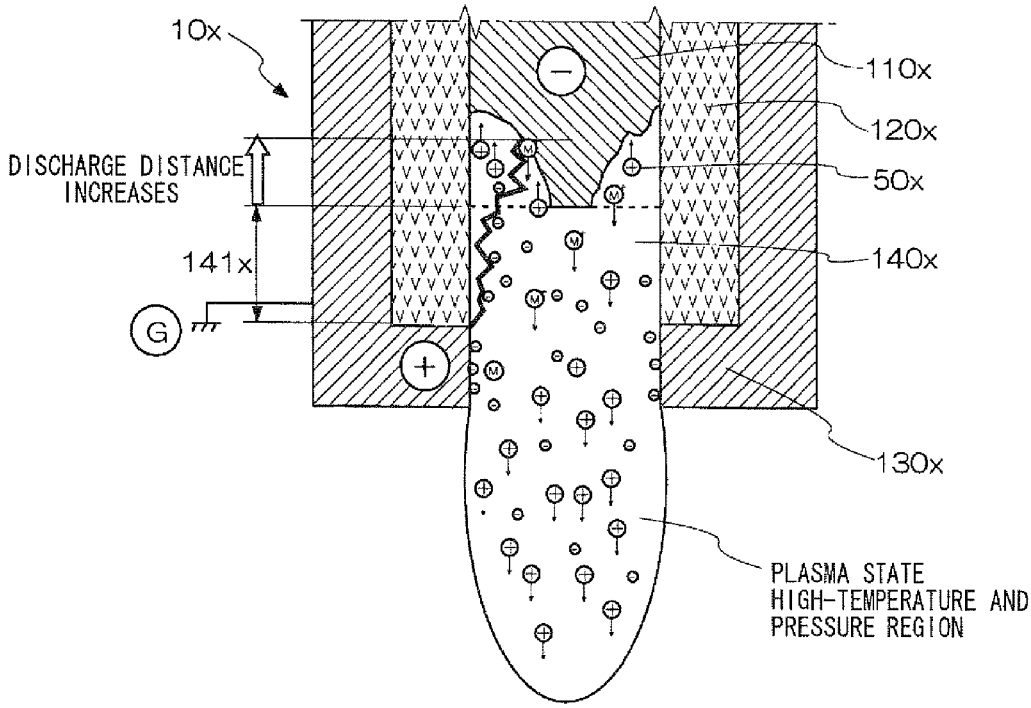
FIG. 11B PRIOR ART
FIG. 11B is a sectional view of a main portion of the previously proposed plasma ignition system illustrating a problem in FIG. 11A.

As shown in FIG. 10, in a plasma ignition plug 10*f* according to a seventh embodiment of the invention, an inner circumferential wall of an insulating member 120*f* is formed in a shape of a trumpet, in which an inner diameter of the insulating member 120*f* becomes larger in a direction from a center electrode 110*f*-side toward a ground electrode 130*f*-side. By virtue of the above configuration, the following advantageous effect is produced in addition to a similar effect to the first embodiment. That is, since the gas in the plasma state is injected through a wide ground electrode opening 131*f*, a plasma injection length Lp becomes short. Accordingly, a surface area of a high temperature region is large and thus the plasma ignition plug 10*f* is expected to be applied to homogeneous lean combustion although it may not be suitable for stratified combustion.

As is obvious, the invention is not limited to the above embodiments, and may be appropriately changed without departing from the scope of the invention. For example, in the above embodiments, the plasma ignition system including a single plasma ignition plug is described. However, the invention may also be applied to a multiple cylinder engine including many ignition plugs. Moreover, in the above embodiments, examples using the high voltage power having a plurality of power sources, that is, the discharge power source 20 and the plasma generation power source 30 are described. Alternatively, a power source for the application of high voltage and a power source for supply of a high current may constitute a single power source.

Additional advantages and modifications will readily occur to those skilled in the art. The invention in its broader terms is therefore not limited to the specific details, representative apparatus, and illustrative examples shown and described.

What is claimed is:

1. A plasma ignition system for an internal combustion engine, comprising:

an ignition plug attached to the engine; and a high-energy supply that supplies electrical energy to the ignition plug, wherein the ignition plug includes:

a center electrode;

a ground electrode; and an insulating member that insulates the center electrode from the ground electrode and defines a discharge space therein, wherein:

the center electrode and the ground electrode are disposed such that at least a part of a surface of the center electrode faces the discharge space and that at least a part of a surface of the ground electrode faces the discharge space;

the ignition plug is configured to release the electrical energy, which is supplied to the ignition plug by the high-energy supply, into a combustion chamber of the engine so as to perform ignition in the engine;

the center electrode is configured to serve as a positive pole;

the ground electrode is configured to serve as a negative pole;

the center electrode has a recess portion, which is opposed to the discharge space and recessed in a direction opposite to an injection direction in which the gas is injected into the engine;

the insulating member has a discharge space defining portion, which defines the discharge space; and a relationship among:

a recess portion opening diameter, which is an opening diameter of the recess portion at an axial end portion thereof facing the discharge space, and a center electrode outer diameter, which is an outer diameter of the center electrode of the recess portion thereof, satisfies the following expressions:

$$\phi D1=\phi D2; \text{ and}$$

$$\phi D2<\phi D3,$$

provided that ϕD1 is the recess portion opening diameter; ϕD2 is the insulating member inner diameter; and ϕD3 is the center electrode outer diameter.

2. The plasma ignition system according to claim 1, wherein:

the center electrode is formed in a shape of a shaft;

the insulating member is formed in a cylindrical shape;

the insulating member covers a periphery of the center electrode and extends further in the injection direction than the center electrode so as to define the discharge space;

the ground electrode is formed in a cylindrical shape;

the ground electrode covers a periphery of the insulating member and extends further in the injection direction than the insulating member to be formed into an opening portion; and the opening portion faces the discharge space and communicates with the discharge space.

3. The plasma ignition system according to claim 2, wherein an inner circumferential wall of the insulating member that defines the discharge space is formed in a shape of a generally circular cone, a diameter of which decreases in the injection direction.

4. The plasma ignition system according to claim 2, wherein an inner circumferential wall of the insulating member that defines the discharge space is formed in a shape of a generally circular cone, a diameter of which increases in the injection direction.

5. The plasma ignition system according to claim 1, wherein:

a relationship between the center electrode outer diameter, which is an outer diameter of the center electrode at the recess portion thereof, and the insulating member inner diameter, which is an inner diameter of the discharge space defining portion, satisfies the following expression:

$$\phi D3<2\times\phi D2,$$

provided that ϕD2 is the insulating member inner diameter and ϕD3 is the center electrode outer diameter.

6. The plasma ignition system according to claim 1, wherein a relationship among a discharge distance, which is a distance from an axial end of the center electrode that faces the discharge space to a surface of the ground electrode at a boundary between the ground electrode and an axial end of the insulating member in the injection direction, a recess portion depth, which is a depth of the recess portion, a discharge space volume, which is a volume of the discharge space, and a recess portion volume, which is a volume of the recess portion, satisfies the following expressions:

$$G2<G1; \text{ and}$$

$$V1<V1+V2<2\times V1,$$

provided that: G1 is the discharge distance; G2 is the recess portion depth; V1 is the discharge space volume; and V2 is the recess portion volume.

7. The plasma ignition system according to claim 1, wherein:

the high-energy supply includes a high-voltage supply that applies high voltage to the ignition plug and supplies a large current to the ignition plug; and the ignition plug is configured to put gas in the discharge space into a plasma state of high temperature and pressure and to inject the gas into the engine as a result of the application of the high voltage to the ignition plug and the supply of the large current to the ignition plug by the high-voltage supply.

* * * * *